US010309185B2

(12) United States Patent
Hiorth

(10) Patent No.: US 10,309,185 B2
(45) Date of Patent: Jun. 4, 2019

(54) RELEASABLE RATCHET DEVICE

(71) Applicant: Interwell Technology AS, Ranheim (NO)

(72) Inventor: Espen Hiorth, Trondheim (NO)

(73) Assignee: Interwell Technology AS, Ranheim (NO)

( * ) Notice: Subject to any disclaimer, the term of this patent is extended or adjusted under 35 U.S.C. 154(b) by 84 days.

(21) Appl. No.: 15/531,289

(22) PCT Filed: Dec. 4, 2015

(86) PCT No.: PCT/EP2015/078656
§ 371 (c)(1),
(2) Date: May 26, 2017

(87) PCT Pub. No.: WO2016/087641
PCT Pub. Date: Jun. 9, 2016

(65) Prior Publication Data

US 2017/0328168 A1 Nov. 16, 2017

(30) Foreign Application Priority Data

Dec. 5, 2014 (NO) ..... 20141476

(51) Int. Cl.
*E21B 23/00* (2006.01)
*E21B 33/12* (2006.01)
*E21B 23/02* (2006.01)

(52) U.S. Cl.
CPC ..... *E21B 33/12* (2013.01); *E21B 23/00* (2013.01); *E21B 23/02* (2013.01)

(58) Field of Classification Search
CPC ..... E21B 33/12; E21B 23/00; E21B 23/02; E21B 33/1295
See application file for complete search history.

(56) References Cited

U.S. PATENT DOCUMENTS 3,746,093 A 7/1973 Mullins
4,477,104 A * 10/1984 Akkerman ..... E21B 17/06 166/124

(Continued)

FOREIGN PATENT DOCUMENTS

WO 2008/005495 A1 1/2008
WO 2014/006392 A2 1/2014

OTHER PUBLICATIONS

International Search Report issued in PCT/EP2015/078656 dated Mar. 22, 2016 (3 pages).

(Continued)

*Primary Examiner* — Yong-Suk Ro
(74) *Attorney, Agent, or Firm* — Osha Liang LLP

(57) ABSTRACT

A releasable ratchet device, including a mandrel device with a grooved area and a locking device including locking grooves configured to be engaged with the grooved area of the mandrel device. The releasable ratchet device may be configured to be in a locked state, in which axial movement between the mandrel device and the locking device is allowed in a first direction when the locking device is engaged with the mandrel device and movement between the mandrel device and the locking device is prevented in a second direction opposite of the first direction when the locking device is engaged with the mandrel device. The releasable ratchet device further includes a releasing device configured to bring the releasable ratchet device to a released state, in which axial movement between the mandrel device and the locking device is allowed in both the first direction and the second direction.

7 Claims, 6 Drawing Sheets

(56) References Cited

U.S. PATENT DOCUMENTS

| | | | | |
|---|---|---|---|---|
| 5,069,280 | A | 12/1991 | McKee et al. | |
| 5,941,306 | A * | 8/1999 | Quinn | E21B 33/1295 166/120 |
| 6,581,681 | B1 * | 6/2003 | Zimmerman | E21B 33/1204 166/135 |
| 2005/0077053 | A1 | 4/2005 | Walker et al. | |
| 2008/0001111 | A1 * | 1/2008 | Ross | E21B 23/04 251/230 |
| 2012/0012303 | A1 * | 1/2012 | Xu | E21B 23/00 166/88.2 |

OTHER PUBLICATIONS

Written Opinion of the International Searching Authority issued in PCT/EP2015/078656 dated Mar. 22, 2016 (6 pages).

Norwegian Search Report issued in Application No. 20141476 dated Jul. 1, 2015 (2 pages).

* cited by examiner

RELEASABLE RATCHET DEVICE

FIELD OF THE INVENTION

The present invention relates to a releasable ratchet device.

BACKGROUND OF THE INVENTION

A ratchet device typically comprises a mandrel device with a grooved area and a locking device comprising locking grooves configured to be engaged with the grooved area of the mandrel device. Axial movement between the mandrel device and the locking device is allowed in a first direction when the locking device is engaged with the mandrel device while movement between the mandrel device and the locking device is prevented in a second direction opposite of the first direction. Hence, a ratchet device may be considered as a locking mechanism for preventing relative movement between two parts in one direction only.

Such ratchet devices are commonly used in tools and/or other type of equipment for use in oil and/or gas wells, such as packers, plugs, straddles etc., where the ratchet device typically is used to allow the tool to be brought from a first state to a second state (for example from a run state to a set state) while preventing the tool going from the second state and back to the first state.

SUMMARY OF THE INVENTION

One or more embodiments of the present invention provide a releasable ratchet device having two states, a first state where the ratchet device is working as a normal ratchet device, i.e. that movement between the mandrel device and the locking device is allowed in one direction only, and a second state where movement between the mandrel device and the locking device is allowed in both directions. In one or more embodiments, the releasable ratchet device can be brought from the first state, to the second state and also back to the first state again a repeated number of times.

One or more embodiments of the present invention relate to a releasable ratchet device, comprising: a mandrel device comprising a grooved area; a locking device comprising locking grooves configured to be engaged with the grooved area of the mandrel device; where the releasable ratchet device may be configured to be in a locked state, in which axial movement between the mandrel device and the locking device is allowed in a first direction when the locking device is engaged with the mandrel device and movement between the mandrel device and the locking device is prevented in a second direction opposite of the first direction when the locking device is engaged with the mandrel device; characterized in that the releasable ratchet device further comprises: a releasing device configured to bring the releasable ratchet device to a released state, in which axial movement between the mandrel device and the locking device is allowed in both the first direction and the second direction. Further details of embodiments of the invention are set forth in the description below.

DETAILED DESCRIPTION

Figure 1:
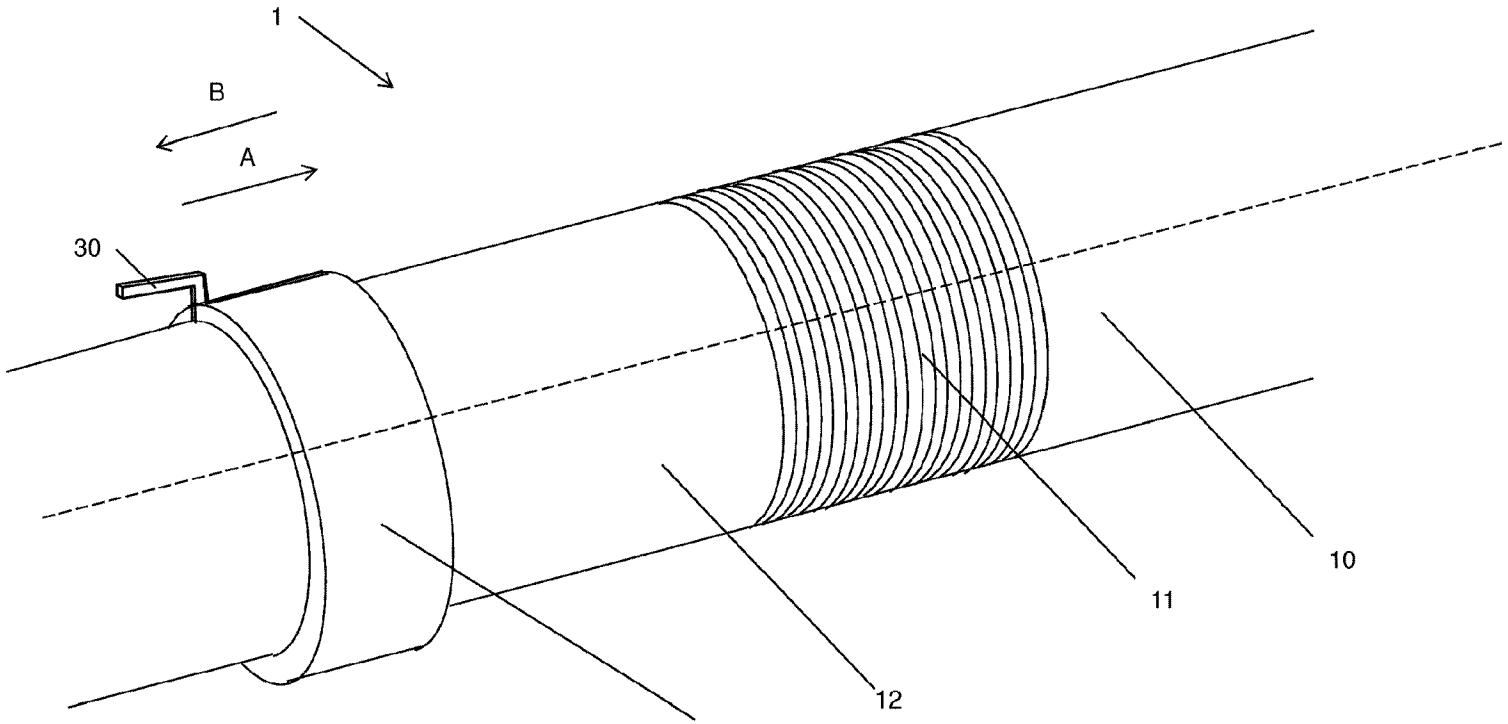
FIG. 1 illustrates a perspective view of a first embodiment of a releasable ratchet device in an initial state.

Embodiments of the invention will now be described with reference to the enclosed drawings. It is now referred to FIG. 1. Here, a releasable ratchet device 1 is shown. The releasable ratchet device 1 is here used in a well tool. Hence, the releasable ratchet device 1 has a substantially cylindrical form, with a longitudinal axis indicated by a dashed line I. The right side of FIG. 1 is the lowermost side of the releasable ratchet device 1 and the left side of FIG. 1 is the uppermost side of the releasable ratchet device 1, i.e. the right side is faced towards the bottom of the well. The releasable ratchet device 1 comprises a mandrel device 10 and a locking device 20.

The mandrel device 10 is substantially cylindrical, where an outside surface of, i.e. a radial outside of, the mandrel device 10 is comprising a grooved area 11 and a smooth area 12. The grooved area 11 is provided circumferentially around the mandrel device 10. The smooth area 12 is also provided circumferentially around the mandrel device 10, but axially displaced in relation to, and adjacent to, the grooved area 11.

Figure 6:
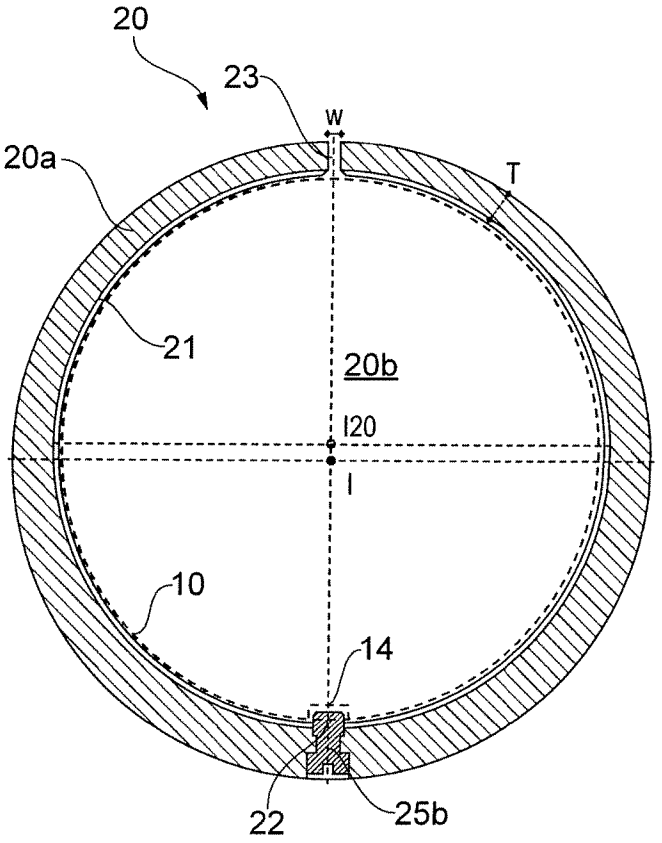
FIG. 6 illustrates a second cross sectional view of the locking device.

In FIG. 6, cross section of the mandrel device 10 is indicated by a dashed line. Here, it is shown that the mandrel device 10 comprises a recess 14 in the longitudinal (i.e. axial) direction.

Figure 3:
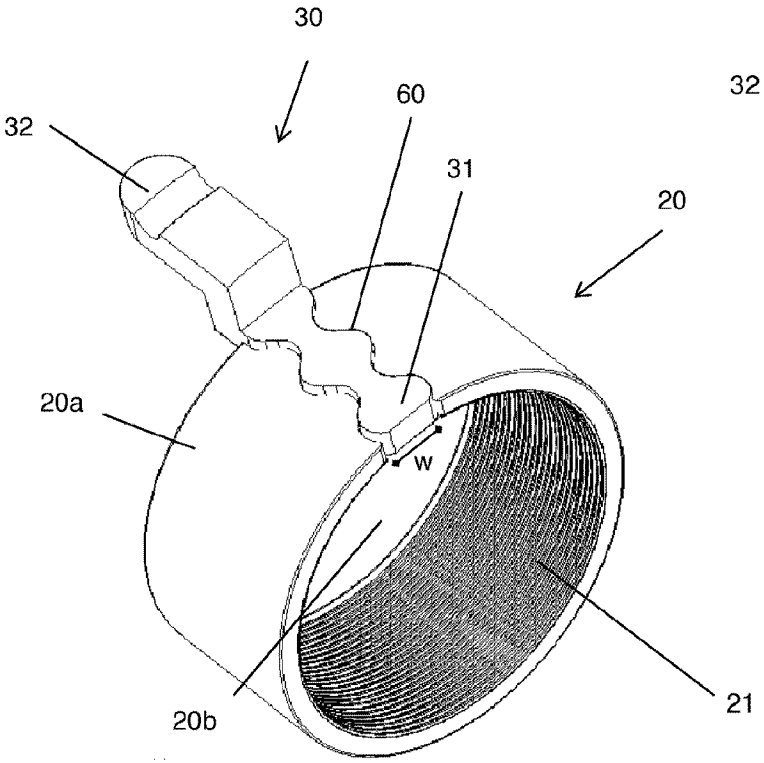
FIG. 3 illustrates a perspective view of the locking device and releasing device in the initial and locked state.

It is now referred to FIG. 3. The locking device 20 comprises a substantially cylindrical locking ring 20*a* with an axial through bore 20*b*. The locking device 20 comprises locking grooves 21 provided on the inner surface of the through bore 20*b*. Hence, the locking grooves 21 are provided radially inside of the locking device 20.

The locking grooves 21 are configured to be engaged with the grooved area 11 of the mandrel device 10. The grooves of the grooved area 11 and the locking grooves 21 have a direction perpendicular to the longitudinal direction I, i.e. to prevent relative axial movement between the locking device and the mandrel device 10 in one direction.

Figure 2:
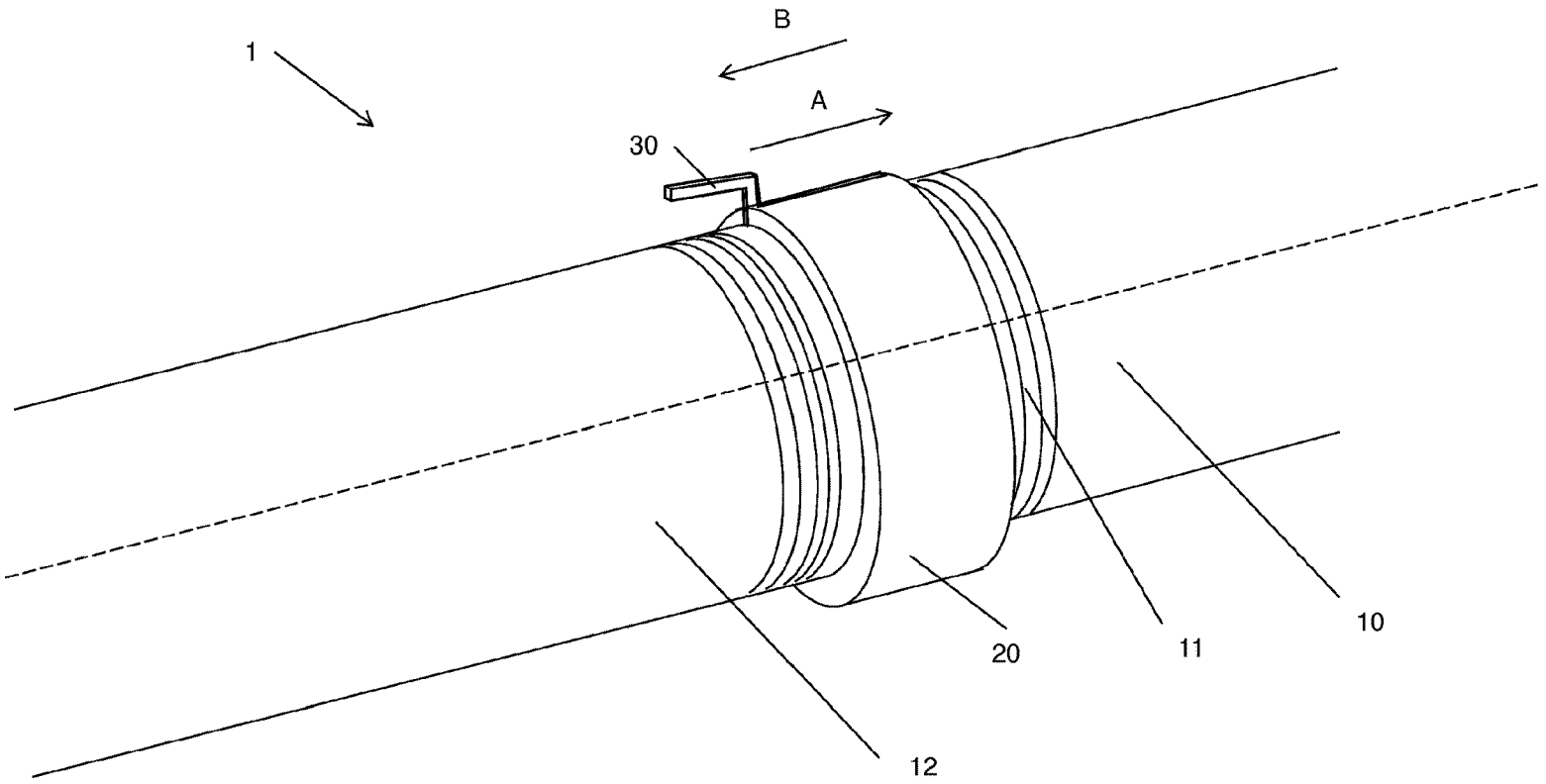
FIG. 2 illustrates a perspective view of the first embodiment in a locked state.

Hence, as is known for a person skilled in the art, a releasable ratchet device 1 may be configured to be in a locked state, in which axial movement between the mandrel device 10 and the locking device 20 is allowed in a first direction A when the locking device 20 is engaged with the mandrel device 10. Moreover, movement between the mandrel device 10 and the locking device 20 is prevented in a second direction B opposite of the first direction A when the locking device 10 is engaged with the mandrel device 20. As indicated in FIGS. 1 and 2, the directions A and B are coinciding with, or parallel with the longitudinal axis I. This may be achieved by providing the grooves of the grooved areas 11 and the locking grooves 21 with different angles, allowing movement in one direction and preventing movement in the opposite direction. This is considered known for a skilled person.

Figure 4:
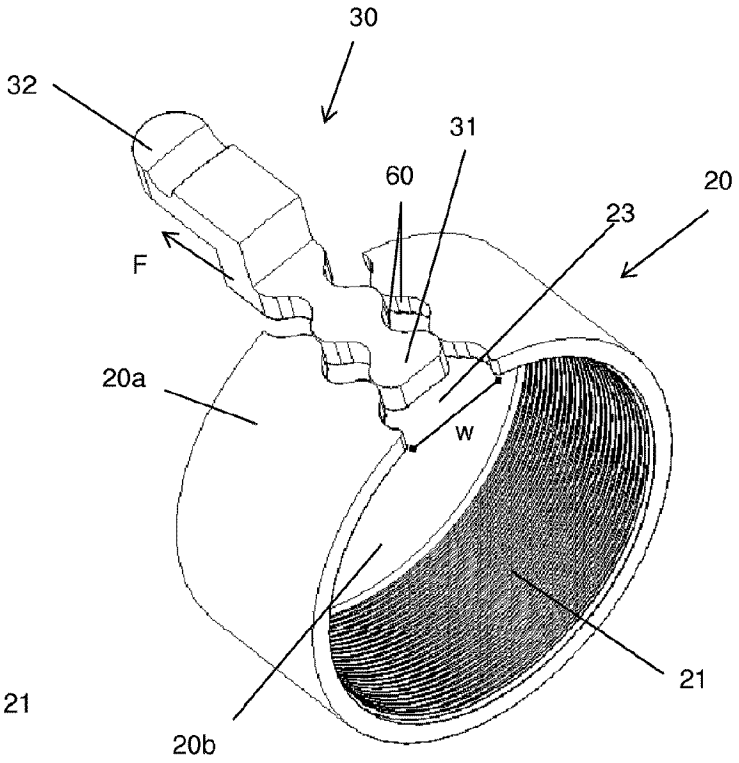
FIG. 4 illustrates a perspective view of the locking device and releasing device in the released state.
Figure 5:
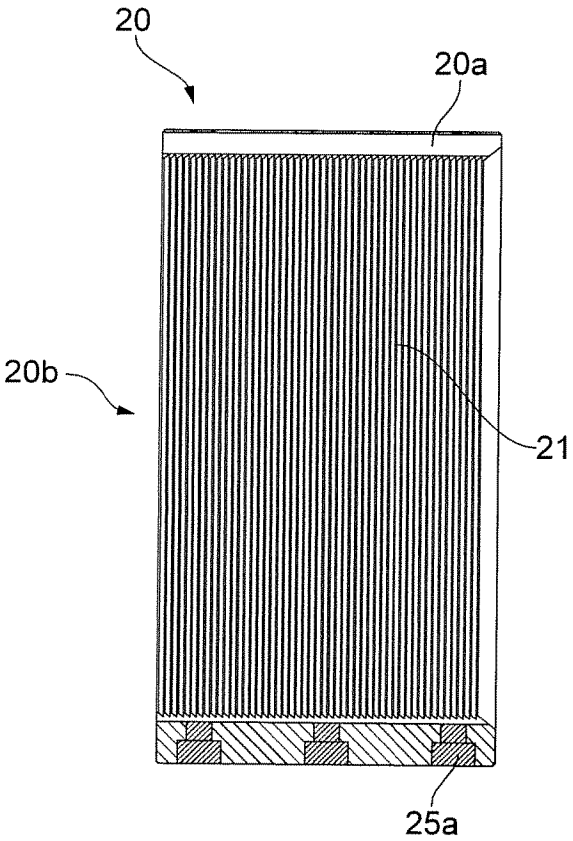
FIG. 5 illustrates a first cross sectional view of the locking device.

It is now referred to FIGS. 4, 5 and 6. A slit 23 is provided axially through the substantially cylindrical locking ring 20*a*. Hence, a radial expansion of the locking ring 20*a* is allowed.

As shown in FIG. 5 a recess 25 is provided in an axial direction in the axial through bore 20*b* of the locking ring 20*a*, on an inner surface of the axial through bore 20*b*. As shown in FIG. 5, three screw holes 25*a* are provided from the outside of the locking ring 20*a* and into the recess 25. As shown in FIG. 6, a fin 22 is fixed in the recess 25 by means of screws 25*b* in the screw holes 25. The fin 22 is protruding radially into the axial through bore 20*b*. When the locking device 20 is provided outside the mandrel device 10, the fin 22 of the locking device 20 is provided in the axial recess 14 in the mandrel device 10. The fin 22 and the recess 14 are forming a guiding device. The guiding device is providing that axial movement between the mandrel device 10 and the locking device 20 is allowed, while rotational movement between the mandrel device 10 and the locking device 20 is prevented due to the engagement of the fin 22 in the axial recess 14.

As shown in FIG. 6, the center axis 120 of the axial through bore 20*b* of the locking ring 20*a* is provided eccentric with respect to the center axis I of the device 1. Hence, a thickness T of the locking ring 20*a* is varying along its circumference. As shown in FIG. 6, the slit 23 is provided in the thinnest part of the locking ring 20*a*, while the fin 22 is located in the thickest part of the locking ring 20*a*. As shown, the fin 22 is provided opposite of the slit 23 in FIG. 6, i.e. the fin 22 is displaced 180° in relation to the slit 23 with respect to the longitudinal axis I. In the unlocked state, the center axis 120 may be closer to, or may coincide with, the center axis I.

It is now referred to FIGS. 3 and 4. Here it is shown that the ratchet device 1 further comprises a releasing device 30. The releasing device 30 comprises a wedging element 31 provided in the axial slit 23 of the locking device 20. The releasing device 30 also comprises a connection element 32. The connection element 32 is connected to an actuator (not shown) of the well tool. The actuator is here considered to control the axial relative movement between the releasing device 30 and the locking device 20. As shown in FIG. 4, relative axial movement between the wedging element 31 and the locking device 20 is configured to provide an increase in the width w of the slit 23. In FIG. 4, the releasable ratchet device 1 is in a released state, where the width w of the slit 23 in the released state is larger than the width w in the locked state. An increase in the width w is also an increase in the diameter of the bore 20*b*.

Consequently, releasing device 30 is configured to press the locking device 20 radially out from engagement with the mandrel device 10 in the released state, i.e. the releasing device 30 is configured to bring the releasable ratchet device 1 to the released state, in which axial movement between the mandrel device 10 and the locking device 20 is allowed in both the first direction A and the second direction B, since the locking grooves 21 in the released state is no longer engaged with the grooved area 11 of the mandrel device 10.

It is now referred to FIGS. 1 and 2 again. In FIG. 1, the locking device 20 is in an initial state, with an axial distance between the grooved area 11 of the mandrel device 10 and the locking ring 20*a*. Here, there is no engagement between the locking grooves 21 of the locking ring 20*a* and the grooves of the grooved area 11. Movement of the locking device 20 in both directions A and b is possible due to the smooth surface 12. In FIG. 2, the locking device 20 is in the locked state described above, and only movement in direction A is possible.

As described above, by axial displacement of the releasing device, the ratchet device 1 is brought to its released state, in which movement is possible in both directions A and B. The locking device 20 together with the releasing device may now be moved back towards the smooth surface 12 and further to the initial state. It should be noted that the locking device 20 and releasing device 30 may be stationary, while the mandrel device 10 is moved to the right in FIG. 2. The state cycle may then be repeated, the releasable ratchet device 1 is configured to be brought from the released state and back to the locked state again.

In the released state, the fin 22 of the locking device 20 will still be located in the recess 14 of the mandrel device 10.

In FIGS. 3 and 4, it is shown that the contact interface 60 between the slit 23 and the wedging element 31 is curved or sine-shaped.

Figure 7:
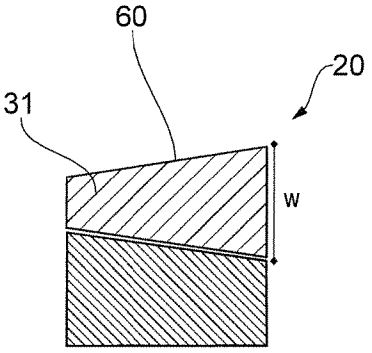
FIG. 7 illustrates an alternative embodiment of the locking device and releasing device in the locked state schematically.
Figure 8:
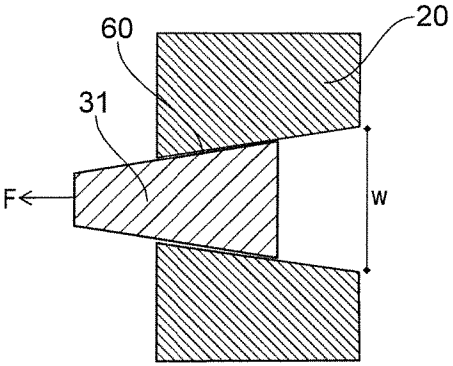
FIG. 8 illustrates the embodiment in FIG. 7 in the released state.

In an alternative embodiment shown in FIGS. 7 and 8, the contact interface 60 between the wedging element 31 and the slit 23 is substantially wedge-shaped or dovetail-shaped.

Figure 9:
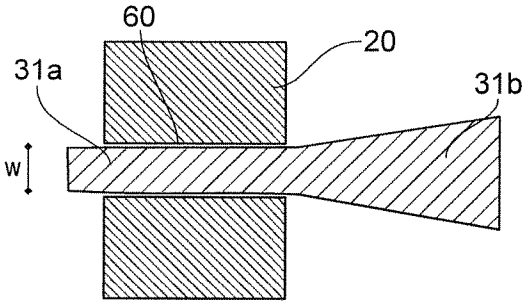
FIG. 9 illustrates yet an alternative embodiment of the locking device and releasing device in the locked state schematically.
Figure 10:
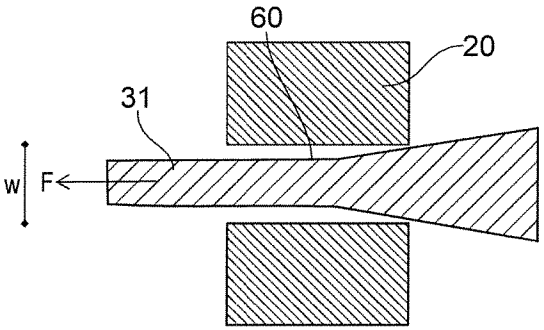
FIG. 10 illustrates the embodiment in FIG. 7 in the released state.

In yet another embodiment shown in FIGS. 9 and 10, the contact interface 60 of the slit 23 is straight, while the corresponding contact surface of the wedge element 31 comprises a straight part 31*a* and a wedge-shaped part 31*b*, where the straight part 31*a* is in contact with the slit 23 in the initial and locked states and the wedge-shaped part 31*b* is in contact with the slit in the released state.

It should be noted that the axial length of the grooved area 11 can be considerably longer than that shown in the drawings.

According to the invention it is possible to reset plugging devices and other well tools several times without the need to pull the well tool to the surface.

Figure 11:
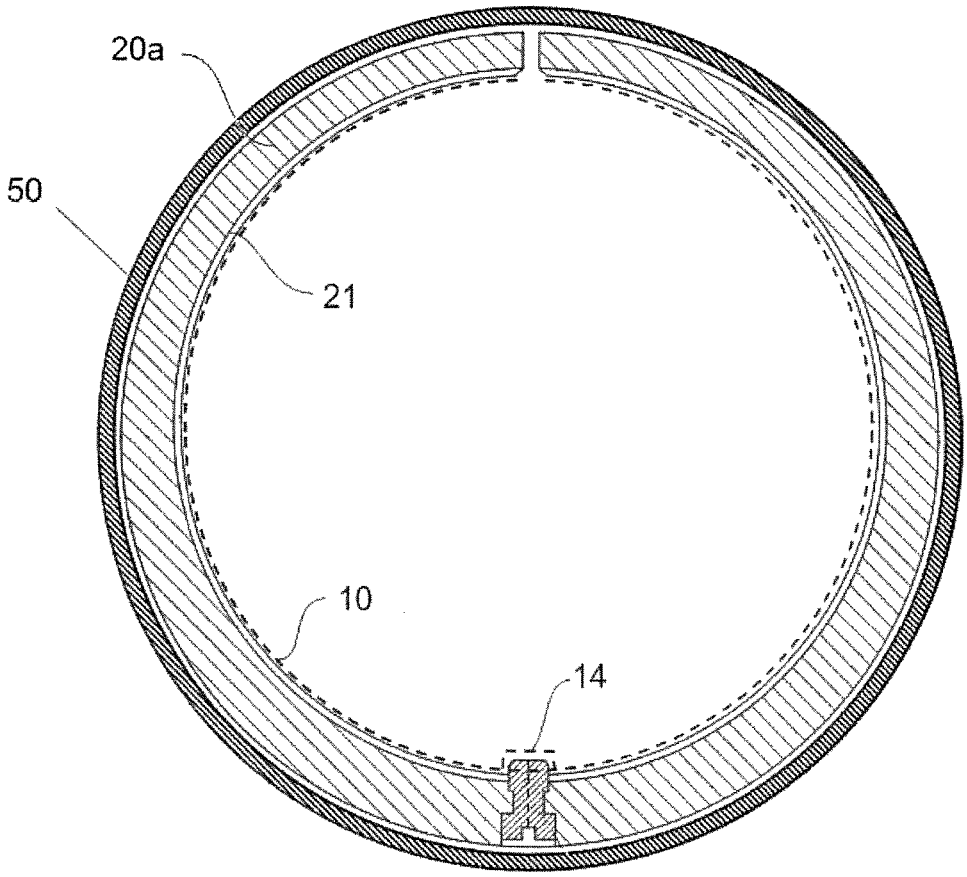
FIG. 11 corresponds to FIG. 6, where an outer housing is provided outside the locking device.

It is now referred to FIG. 11. FIG. 11 corresponds to FIG. 6. In FIG. 11, an outer housing 50 is provided radially outside of the locking device 20. The outer housing has an inner diameter being slightly larger than the outer diameter of the locking ring 20*a* when the locking ring is in its expanded or unlocked state. The outer housing will ensure that the centre axis 120 of the locking ring 20*a* is substantially coinciding with the centre axis I of the device 1 in the unlocked or expanded state. Hence, it is avoided that only some of the locking grooves 21 are engaged with the grooved area 11 in the unlocked or expanded state. If the locking grooves 21 are only partially engaged with the grooved area when radially expanded, movement in direction B will still be prevented, and the device can not be considered to be in its locked state.

The outer housing 50 may be used for all embodiments described above. It should be noted that the outer housing may comprise a recess (not shown) for the releasing device 30.

The invention claimed is:

1. A releasable ratchet device, comprising:

a mandrel device comprising a grooved area; and a locking device comprising locking grooves;

wherein grooves of the grooved area and the locking grooves are provided with different angles, and wherein the locking grooves are configured to be engaged with the grooved area of the mandrel device, wherein, when the releasable ratchet device, due to the different angles of the grooves of the grooved area and the locking grooves, is in a locked state, axial movement between the mandrel device and the locking device is allowed in a first direction when the locking device is engaged with the mandrel device and movement between the mandrel device and the locking device is prevented in a second direction opposite of the first direction when the locking device is engaged with the mandrel device, wherein the releasable ratchet device further comprises:

a releasing device that brings the releasable ratchet device to a released state, in which the locking device is pressed radially out from engagement with the mandrel device, wherein axial movement between the mandrel device and the locking device is allowed in both the first direction and the second direction, wherein the mandrel device comprises an axial recess, and wherein the locking device comprises a fin provided in the axial recess in the mandrel device, wherein rotational movement between the mandrel device and the locking device is prevented due to the engagement of the fin in the axial recess.

2. The releasable ratchet device according to claim 1, wherein the locking grooves are provided radially inside of the locking device, and wherein the grooved area is provided radially outside of the mandrel device.

3. The releasable ratchet device according to claim 1, wherein the releasing device presses the locking device radially out from engagement with the mandrel device in the released state.

4. The releasable ratchet device according to claim 1, wherein the locking device comprises an axial slit having a width, and wherein the width of the axial slit is larger in the released state than in the locked state.

5. The releasable ratchet device according to claim 4, wherein the releasing device comprises a wedging element provided in the axial slit of the locking device, and wherein relative axial movement between the wedging element and the locking device provides an increase in the width of the slit in the released state.

6. The releasable ratchet device according to claim 1, wherein the releasable ratchet device is brought from the locked state to the released state by relative axial movement between the locking device and the releasing device.

7. The releasable ratchet device according to claim 1, wherein the releasable ratchet device is brought from the released state and back to the locked state again.

* * * * *